US005528102A

United States Patent [19]

Gnade et al.

[11] Patent Number: 5,528,102

[45] Date of Patent: Jun. 18, 1996

[54] ANODE PLATE WITH OPAQUE INSULATING MATERIAL FOR USE IN A FIELD EMISSION DISPLAY

[75] Inventors: Bruce E. Gnade; Daron G. Evans; Scott R. Summerfelt; Jules D. Levine, all of Dallas, Tex.

[73] Assignee: Texas Instruments Incorporated, Dallas, Tex.

[21] Appl. No.: 491,747

[22] Filed: Jun. 19, 1995

Related U.S. Application Data

[63] Continuation of Ser. No. 247,951, May 24, 1994, abandoned.

[51] Int. Cl.[6] ..... H01J 1/62

[52] U.S. Cl. ..... 313/496; 313/309

[58] Field of Search ..... 313/461, 496, 313/495, 497, 309, 310

[56] References Cited

U.S. PATENT DOCUMENTS

| | | | |
|---|---|---|---|
| 3,755,704 | 8/1973 | Spindt et al. . | |
| 3,906,285 | 9/1975 | Kobayakawa et al. | 313/496 |
| 4,098,939 | 7/1978 | Kuroda et al. | 313/496 |
| 4,140,941 | 2/1979 | Uemura | 313/495 |
| 4,352,042 | 9/1982 | Lorentz et al. | 313/485 |
| 4,472,658 | 9/1984 | Morimoto et al. | 313/497 |
| 4,622,272 | 11/1986 | Wengert et al. | 313/503 |
| 4,720,655 | 1/1988 | Hinotani et al. | 313/422 |
| 4,757,234 | 7/1988 | Ikuta et al. | 313/496 |
| 4,837,097 | 6/1989 | Narang et al. | 430/5 |
| 4,940,916 | 7/1990 | Borel et al. . | |
| 5,194,780 | 3/1993 | Meyer . | |
| 5,225,820 | 7/1993 | Clerc . | |
| 5,953,659 | 9/1995 | Wallace et al. | 313/496 |

*Primary Examiner*—Michael Horabik
*Assistant Examiner*—Michael Day
*Attorney, Agent, or Firm*—Christopher L. Maginniss; W. James Brady, III; Richard L. Donaldson

[57] ABSTRACT

An anode plate 50 for use in a field emission flat panel display device comprises a transparent planar substrate 58 having a plurality of electrically conductive, parallel stripes 52 comprising the anode electrode of the device, which are covered by phosphors $\mathbf{54}_R$, $\mathbf{54}_G$ and $\mathbf{54}_B$. A substantially opaque, electrically insulating material 56 is affixed to substrate 58 in the spaces between conductors 52, acting as a barrier to the passage of ambient light into and out of the device. The electrical insulating quality of opaque material 56 increases the electrical isolation of conductive stripes 52 from one another, reducing the risk of breakdown due to increased leakage current. Opaque material 56 preferably comprises glass having impurities dispersed therein, wherein the impurities may include one or more organic dyes, selected to provide relatively uniform opacity over the visible range of the electromagnetic spectrum. Alternatively, the impurities may include the black oxide of a transition metal such as cobalt. Opaque material 56 is formed by mixing a TEOS solution with a dye or a source of metallic ions, spinning or spreading the mixture on glass substrate 58, and curing the mixture to drive out the organics and solvents. Two methods of fabricating anode plate 50 are disclosed.

27 Claims, 3 Drawing Sheets

TRANSMISSIVITY (PERCENT)
60
40
20
0
70
72
400
500
600
700
800
WAVELENGTH (NANOMETERS)

86
84
82
80

86
86
84
82
80

86
86
84
84
82
80

84
84
82
80

90
84
88
82
84
80

88
90
84
84
82
80

84
90
88
84
82
80

84
88
84
82
80

ANODE PLATE WITH OPAQUE INSULATING MATERIAL FOR USE IN A FIELD EMISSION DISPLAY

This application is a continuation, of application Ser. No. 08/247,951, filed May 24, 1994, now abandoned.

TECHNICAL FIELD OF THE INVENTION

The present invention relates generally to flat panel displays and, more particularly, to an opaque insulator for use on the anode plate of a flat panel display which improves the contrast ratio of the display, and to methods for preparing the opaque insulating material and for applying the material to the anode plate.

BACKGROUND OF THE INVENTION

For more than half a century, the cathode ray tube (CRT) has been the principal electronic device for displaying visual information. The widespread usage of the CRT may be ascribed to the remarkable quality of the display characteristics in the realms of color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers has created intense demand for displays which are lightweight, compact and power efficient. Since the space available for the display function of these devices precludes the use of a conventional CRT, there has been significant interest in efforts to provide satisfactory so-called "flat panel displays" or "quasi flat panel displays," having comparable or even superior display characteristics, e.g. , brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color liquid crystal display screens tend to be far more costly than CRT's of equal screen size.

As a result of the drawbacks of liquid crystal display technology, field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5, 194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Fr éd éric Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

Two shortcomings of field emission displays of the current technology are the low contrast ratio of the display and the low emission intensity of the low voltage phosphors typically used as the luminescent materials on the display screen. The low contrast ratio is due in part to ambient light which enters through the front of the display, reflects off the planar surface of the emitter plate, and re-emerges between the phosphor stripes on the switched anode color display.

The low emission intensity of the phosphor has several origins, one of which is the low acceleration voltage used to excite the free electrons toward the anode. Currently, this acceleration voltage is limited by the potential which can be placed on the transparent stripe anode conductors underlaying the phosphor stripes. As the acceleration voltage is increased, the leakage current between the conductive anode stripes also increases, eventually leading to breakdown when the leakage current becomes excessive.

In view of the above, it is clear that there exists a need for an improvement in the anode structure of a field emission flat panel display device which permits increased contrast ratio and increased acceleration voltage to provide higher efficiency of the phosphor material being used.

SUMMARY OF THE INVENTION

In accordance with the principles of the present invention, there is disclosed herein an anode plate for use in a field emission device. The anode plate comprises a substantially transparent substrate having spaced-apart, electrically conductive regions thereon, and luminescent material overlaying the conductive regions. The anode plate further comprises a substantially opaque, electrically insulating material on the substrate in the spaces between the conductive regions.

In a preferred embodiment of the present invention, the opaque material comprises glass having impurities dispersed therein, wherein the impurities may include one or more organic dyes. Alternatively, the impurities may include the oxides of one or more transition metals.

Further in accordance with the principles of the present invention, there is disclosed herein a method of fabricating an anode plate for use in a field emission device. The method comprises the steps of providing a substantially transparent substrate having spaced-apart, electrically conductive regions on a surface thereof, coating the surface with a substantially opaque material, removing the opaque material from areas overlaying the conductive regions, and applying luminescent material on the conductive regions.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
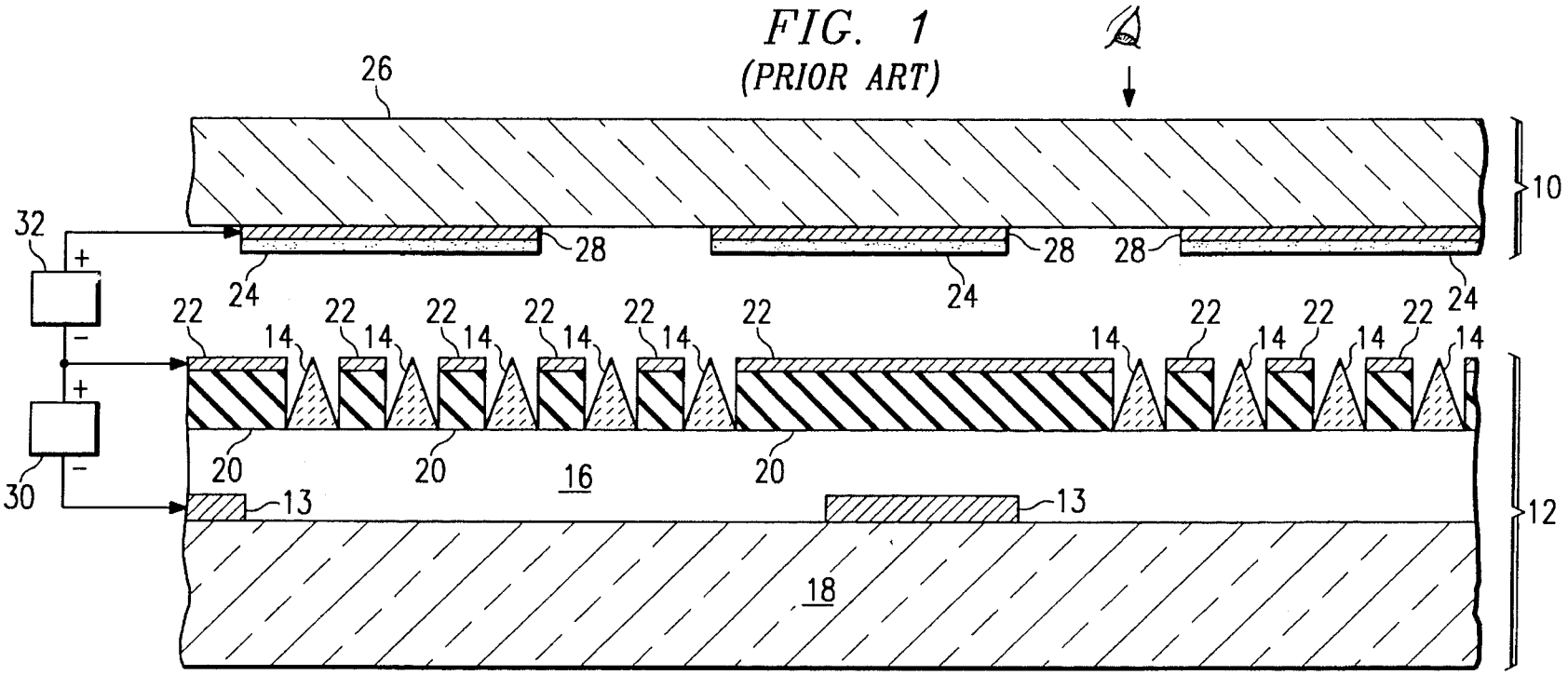
FIG. 1 (PRIOR ART)
FIG. 1 illustrates in cross section a portion of a field emission flat panel display device according to the prior art.

Referring initially to FIG. 1, there is shown, in cross-sectional view, a portion of an illustrative, prior art field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a layer of an electrically conductive material 22 which is deposited on an insulating layer 20 which overlays resistive layer 16. Microtip emitters 14 are in the shape of cones which are formed within apertures through conductive layer 22 and insulating layer 20. The thicknesses of gate electrode layer 22 and insulating layer 20 are chosen in such a way that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material 28 deposited on a transparent planar support 26, which is positioned facing gate electrode 22 and parallel thereto, the conductive material 28 being deposited on the surface of support 26 directly facing gate electrode 22. In this example, the regions of conductive material 28, which comprise the anode electrode, are in the form of electrically isolated stripes comprising three series of parallel conductive bands across the surface of support 26, as taught in the Clerc ('820) patent. (No true scaling information is intended to be conveyed by the relative sizes and positioning of the elements of anode plate 10 and the elements of emitter plate 12 as depicted in FIG. 1.) Anode plate 10 also comprises a cathodoluminescent phosphor coating 24, deposited over conductive regions 28 so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive regions 28 functioning as the anode electrode. Energy from the electrons attracted to the anode conductors 28 is transferred to the phosphor coating 24, resulting in luminescence. The electron charge is transferred from phosphor coating 24 to conductive regions 28, completing the electrical circuit to voltage supply 32.

Figure 2:
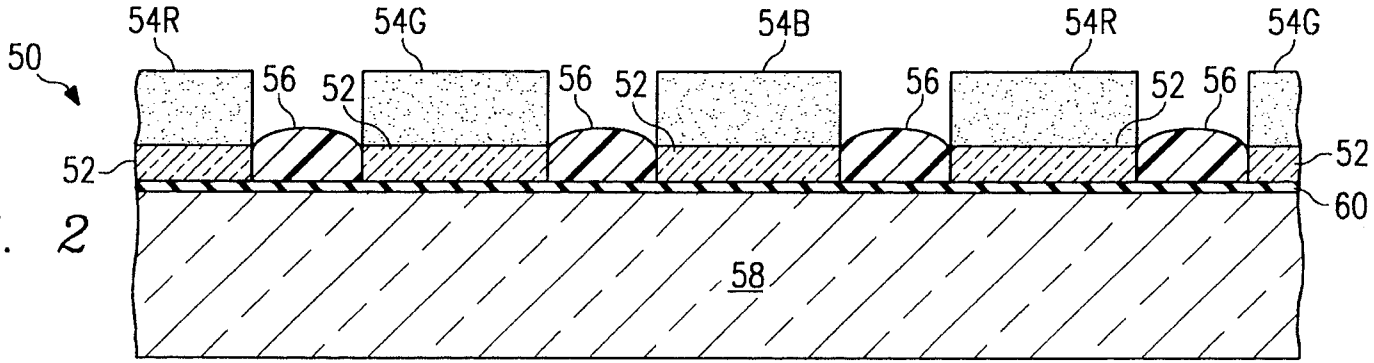
FIG. 2 is a cross-sectional view of an anode plate for use in a field emission flat panel display device in accordance with the present invention.

Referring now to FIG. 2, there is shown a cross-sectional view of an anode plate 50 for use in a field emission flat panel display device in accordance with the present invention. Anode plate 50 comprises a transparent planar substrate 58 having a layer 60 of an insulating material, illustratively silicon dioxide ($SiO_2$). A plurality of electrically conductive regions 52 are patterned on insulating layer 60. Conductive regions 52 collectively comprise the anode electrode of the field emission flat panel display device of the present invention. Luminescent material $\mathbf{54}_R$, $\mathbf{54}_G$ and $\mathbf{54}_B$, referred to collectively as luminescent material 54, overlays conductors 52. Finally, a substantially opaque, electrically insulating material 56 is affixed to substrate 58 in the spaces between conductors 52. It can be seen that opaque material 56 fills in the gaps between conductive regions 52, thereby acting as a barrier to the entry of ambient light into the device, and further preventing the re-emergence of ambient light which is reflected from the active surface of emitter plate 12 (of FIG. 1). In addition, by virtue of its electrical insulating quality, opaque material 56 serves to increase the electrical isolation of conductive regions 52 from one another, thereby permitting the use of higher anode potentials without the risk of breakdown due to increased leakage current.

For purposes of this disclosure, the term "opaque" shall refer to a very low degree of optical transmissivity in the visible range, i.e., in the region of the electromagnetic spectrum between approximately 400–800 nanometers.

In the present example, substrate 58 comprises glass. Also in this example, conductive regions 52 comprise a plurality of parallel stripe conductors which extend normal to the plane of the drawing sheet. A suitable material for use as stripe conductors 52 may be indium-tin-oxide (ITO), which is optically transparent and electrically conductive. In this example, luminescent material 54 comprises a particulate phosphor coating which luminesces in one of the three primary colors, red ($\mathbf{54}_R$), green ($\mathbf{54}_G$) and blue ($\mathbf{54}_B$). A preferred process for applying phosphor coatings 54 to stripe conductors 52 comprises electrophoretic deposition.

By way of illustration, stripe conductors 52 may be 80 microns in width, and spaced from one another by 30 microns. The thickness of conductors 52 may be approximately 150 nanometers, and the thickness of phosphor coatings 54 may be approximately 15 microns.

According to the present invention, the substantially opaque, electrically insulating material 56 preferably comprises glass having impurities dispersed therein, wherein the impurities may include one or more organic dyes, the combination of dyes being selected to provide relatively uniform opacity over the visible range of the electromagnetic spectrum. Alternatively, the impurities may include an oxide of a transition metal, the transition metal being chosen from among those which form black oxides. In the latter case, the metallic oxide particles must be sufficiently dispersed within the glass such that material 56 retains a high degree of electrical insulating quality. By way of illustration, the average thickness of material 56 may be on the order of 500–1000 nanometers.

Opaque, electrically insulating material 56 is preferably formed from a solution or tetraethylorthosilicate (TEOS), which is sold by, for example, Allied Signal Corp., of Morristown, N.J. The solution of TEOS, including a solvent which may comprise ethyl alcohol, acetone, N-butyl alcohol and water, is commonly referred to as "spin-on-glass" (SOG). The TEOS and solvents are combined in proportions according the desired viscosity of the spin-on-glass solution. TEOS provides the advantages that it cures at a relatively low temperature and, when fully cured, all of the solvent and most of the organic materials have been driven out, leaving primarily glass ($SiO_x$). The TEOS solution may be spun on the surface of anode plate 50, or it may be spread on the surface, using techniques which are well known in the manufacture of, for example, liquid crystal display devices.

The impurities which produce the opacity of material 56 fall into two general categories, organic dyes and metallic oxides. Organic dyes are advantageous in that they disperse readily and uniformly throughout the TEOS solution, without diminishing its insulating quality, but they are limited in the temperature range to which they can be exposed, typically to less than 200° C.

Figure 3:
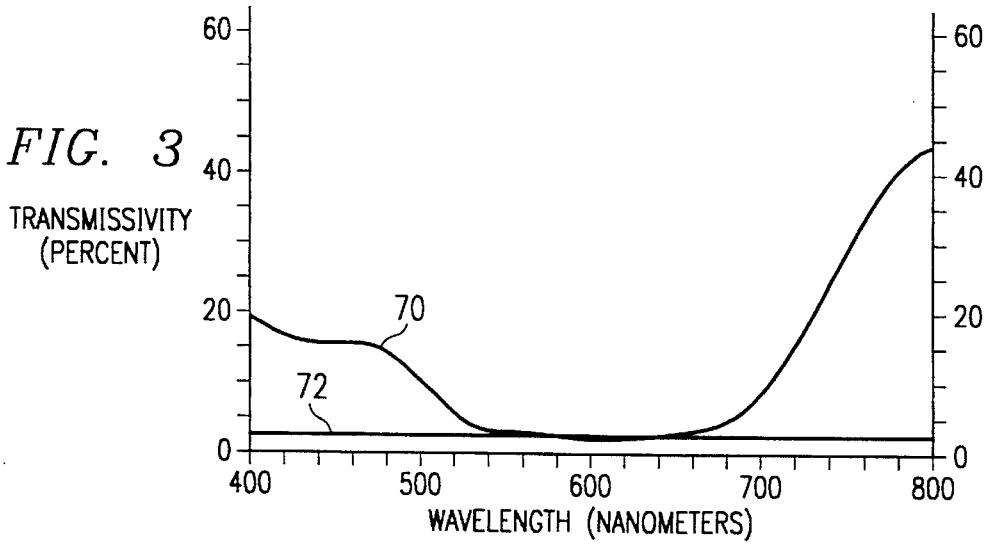
FIG. 3 is a plot of transmissivities within the spectrum of visible light of materials described for use in the present invention.

The following example illustrates a formulation of material 56 including an organic dye. Either a single dye, such as Sudan Black, or a mixture of dyes, is added at a typical concentration of 13 mg of dye/ml of the solution of TEOS and solvents. Trace 70 of the optical transmissivity v. wavelength plot of FIG. 3 represents the performance of a 2,000 nanometer thick film of the above-described mixture. Trace 70 shows that the transmissivity of this mixture is less than fifty percent over the range of 400–800 nanometers, which includes the spectrum of visible light.

The second category of impurities which produce the opacity of material 56 comprises metallic oxides. Compounds of transition metals which are soluble in the TEOS solution provide sources of metallic ions which may form dark, preferably black, oxides during the TEOS curing process. Such compounds may include, but are not limited to, nitrates, sulfates, hydroxides, acetates and other metal organic compounds of the transition metals. Transition metals which form black oxides include, but are not limited to, cobalt and copper. In most cases, the transition metal ion is converted to the metal oxide during the curing cycle.

The following example illustrates a formulation of material 56 including a compound of a transition metal. Cobalt nitrate ($Co(NO_3)_2$) is added to a solution of TEOS and solvent, comprising alcohol and acetone, in the amount of 375 mg/ml. This combination also includes 0.5 ml of 1-butanol per ml of the TEOS solution to improve the uniformity of the mixture. Trace 72 of the optical transmissivity v. wavelength plot of FIG. 3 represents the performance of a 3,000 nanometer thick film of the above-described mixture. Trace 72 shows that the transmissivity of this mixture is approximately three percent over the range of 400–800 nanometers, which includes the spectrum of visible light. As is the case for organic dyes, a plurality of different metal ion solutions, each of which is opaque over a portion of the visible spectrum, can be combined to minimize the optical transmission over the entire range from 400–800 nanometers.

Figure 4A:
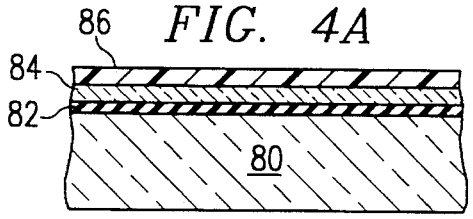
FIGS. 4A through 4H illustrate steps in a process for fabricating the anode plate of FIG. 2 in accordance with a first embodiment of the present invention.

A method of fabricating an anode plate for use in a field emission flat panel display device in accordance with a first embodiment incorporating the principles of the present invention, comprises the following steps, considered in relation to FIGS. 4A through 4H. Referring initially to FIG. 4A, a glass substrate 80 is coated with an insulating layer 82, typically $SiO_2$, which may be sputter deposited to a thickness of approximately 50 nm. A layer 84 of a transparent, electrically conductive material, typically indium-tin-oxide (ITO), is deposited on layer 82, illustratively by sputtering to a thickness of approximately 150 nm. A layer 86 of photoresist, illustratively type AZ-1350J sold by Hoescht-Celanese, of Somerville, N.J., is coated over layer 84, to a thickness of approximately 1000 nm.

Figure 4B:
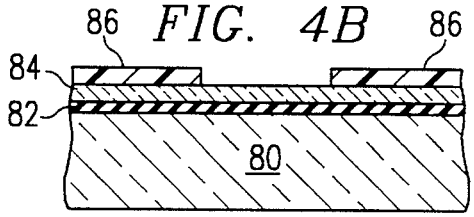
Figure 4C:
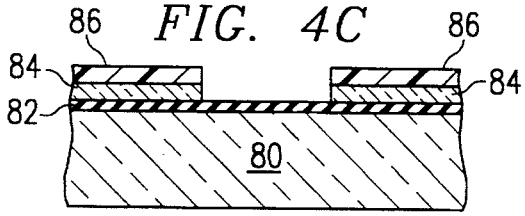
Figure 4D:
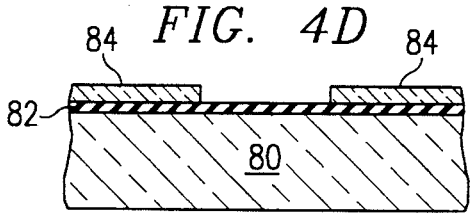

A patterned mask (not shown) is disposed over layer 86 exposing regions of the photoresist. In the case of this illustrative positive photoresist, the exposed regions are removed during the developing step, which may comprise soaking the assembly in Hoescht-Celanese AZ-developer. The developer removes the unwanted photoresist, leaving photoresist layer 86 patterned as shown in FIG. 4B. The exposed regions of ITO layer 84 are then removed, typically by a wet etch process, using as an illustrative etchant a solution of 6 M hydrochloric acid (HCl) and 0.3 M ferric chloride ($FeCl_3$), leaving a structure as shown in FIG. 4C. Although not shown as part of this process, it may also be desired to remove $SiO_2$ layer 82 underlying the etched-away regions of the ITO layer 84. In the present example, these patterning, developing and etching processes leave regions of ITO layer 84 which form substantially parallel stripes across the surface of the anode plate. The remaining photoresist layer 86 may be removed by a wet etch process using acetone as the etchant; alternatively, layer 86 may be removed using a dry, oxygen plasma ash off process. FIG. 4D illustrates the anode structure having patterned ITO regions 84 at the current stage of the fabrication process.

Figure 4E:
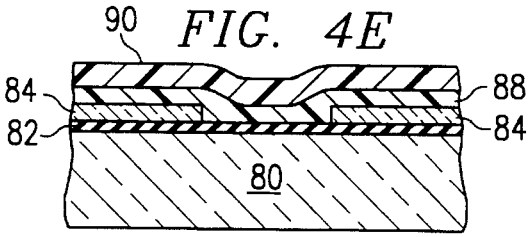

A coating 88 of spin-on-glass (SOG) including impurities which provide opacity, which may be of a type described earlier, is applied over the striped regions of layer 84 and the exposed portion of layer 82, typically to an average thickness of approximately 1000 nm above the surface of insulating layer 82. The method of application may comprise dispensing the SOG mixture onto the assembly while substrate 80 is being spun, thereby dispersing SOG coating 88 relatively uniformly over the surface and tending to accelerate the drying of the SOG solvent. Alternatively, the SOG mixture may be uniformly spread over the surface. The SOG is then precured at 100° C. for about fifteen minutes, and then fully cured by heating it until virtually all of the solvent and organics have been driven off, typically at a temperature of 300° C. for approximately four hours. A second coating 90 of photoresist, which may be of the same type used as layer 86, is deposited over the cured SOG, typically to a thickness of 1000 nm, as illustrated in FIG. 4E.

Figure 4F:
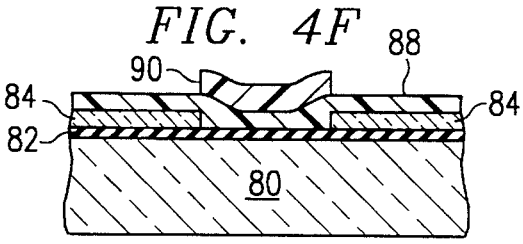
Figure 4G:
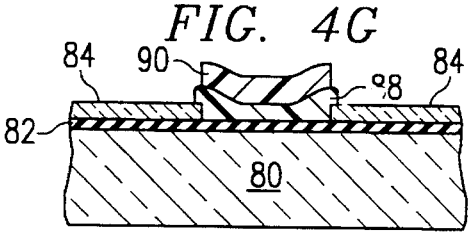

A second patterned mask (not shown) is disposed over layer 90 exposing regions of the photoresist which, in the case of this illustrative positive photoresist, are to be removed during the developing step, specifically these regions lying directly over the spaces between the stripes of layer 84. The photoresist is developed using AZ-developer, leaving photoresist layer 90 patterned as shown in FIG. 4F. The exposed regions of SOG layer 88 are then removed, typically by a wet etch process, using hydrofluoric acid (HF) buffered with ammonium fluoride ($NH_4F$) as an illustrative etchant, leaving a structure as shown in FIG. 4G. Alternatively, the exposed regions of SOG layer 88 may be removed using an oxide (plasma) etch process.

Figure 4H:
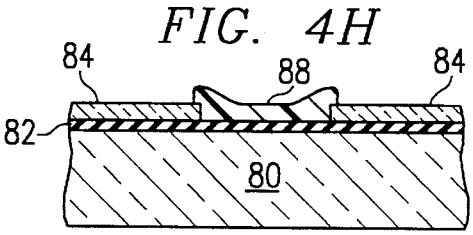

The remaining photoresist layer 90 may be removed by a wet etch process using acetone as the etchant; alternatively, layer 90 may be removed using a dry, oxygen plasma etch process. FIG. 4H illustrates the anode structure having glass insulating regions 88 between the patterned ITO stripes 84 at this stage of the fabrication process. The final steps in the fabrication process of the anode structure is to provide the cathodoluminescent phosphor coatings 54 (of FIG. 2), which are deposited over conductive ITO regions 84, typically by electrophoretic deposition.

Figure 5A:
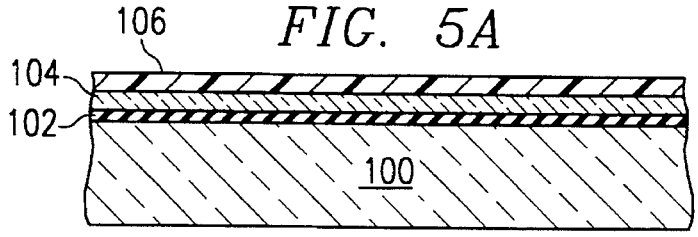
FIGS. 5A through 5E illustrate steps in a process for fabricating the anode plate of FIG. 2 in accordance with a second embodiment of the present invention.

A method of fabricating an anode plate for use in a field emission flat panel display device in accordance with a second embodiment incorporating the principles of the present invention, comprises the following steps, considered in relation to FIGS. 5A through 5E. Referring initially to FIG. 5A, a glass substrate 100 is coated with an insulating layer 102, typically $SiO_2$, which may be sputter deposited to a thickness of approximately 50 nm. A layer 104 of a transparent, electrically conductive material, typically indium-tin-oxide (ITO), is deposited on layer 102, illustratively by sputtering to a thickness of approximately 150 nm. A layer 106 of photoresist, which may be type SC-100 negative photoresist sold by OGC Microelectronic Materials, Inc., of West Patterson, N.J., is coated over layer 104, to a thickness of approximately 1000 nm.

Figure 5B:
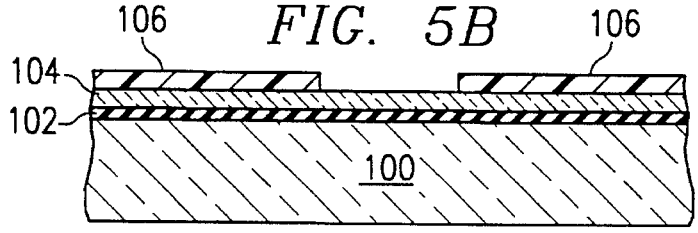
Figure 5C:
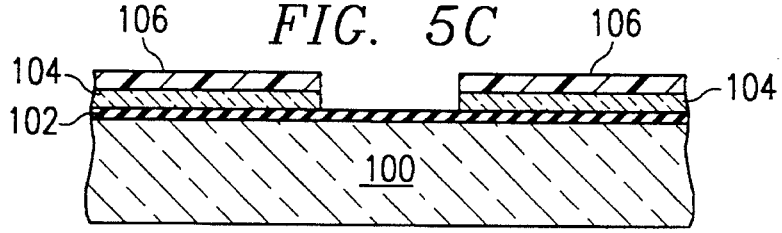
Figure 5D:
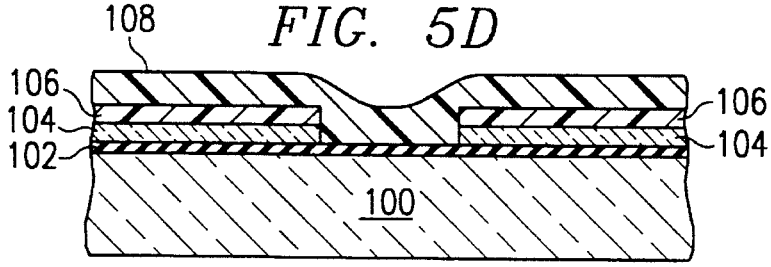

A patterned mask (not shown) is disposed over layer 106 exposing regions of the photoresist which, in the case of this illustrative negative photoresist, are to remain after the developing step, which may comprise spraying the assembly first with Stoddard etch and then with butyl acetate. The unexposed regions of the photoresist are removed during the developing step, leaving photoresist layer 106 patterned as shown in FIG. 5B. The exposed regions of ITO layer 104 are then removed, typically by a wet etch process, using as an illustrative etchant a solution of 6 M hydrochloric acid (HCl) and 0.3 M ferric chloride ($FeCl_3$), leaving a structure as shown in FIG. 5C. In the present example, these patterning, developing and etching processes leave regions of ITO layer 104 which form substantially parallel stripes across the surface of the anode plate. In this second embodiment, the remaining photoresist layer 106 is retained, and a coating 108 of spin-on-glass (SOG) including impurities which provide opacity, which may be of a type described earlier, is applied over the photoresist layer 104 and the exposed portion of layer 102, typically to an average thickness of approximately 1000 nm above the surface of insulating layer 102. The method of application may comprise dispensing the SOG mixture onto the assembly while substrate 100 is being spun, thereby dispersing SOG coating 108 relatively uniformly over the surface and tending to accelerate the drying of the SOG solvent. Alternatively, the SOG mixture may be uniformly spread over the surface. FIG. 5D illustrates the anode structure having patterned ITO regions 104 and photoresist regions 106, and the coating of SOG 108 at the current stage of the fabrication process. The assembly is then heated to 100° C. for about fifteen minutes to remove most of the solvent.

Figure 5E:
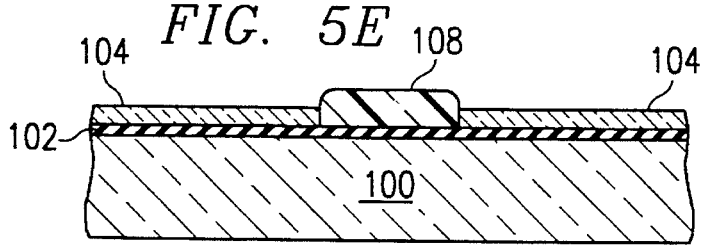

Photoresist layer 106 is then removed, bringing with it the overlaying portions of SOG layer 108, resulting in the structure shown in FIG. 5E. This liftoff process is a common semiconductor fabrication process. Hot xylene and a solvent comprising perchloroethylene, tetrachloroethylene, orthodichlorobenzene, phenol and alkylaryl sulfonic acid, may be sprayed on the assembly in sequence, to remove the negative photoresist layer 106 and the overlaying SOG of the present example. The remaining SOG is then fully cured by heating it until virtually all of the solvent and organics have been driven off, typically at a temperature of 300° C. for approximately four hours. The final steps in the fabrication process of the anode structure is to provide the cathodoluminescent phosphor coatings 54 (of FIG. 2), which are deposited over conductive ITO regions 104, typically by electrophoretic deposition. It will be seen that this process is self-aligning in that it requires only a single mask step to etch IT0 stripes 104 and to form SOG insulator 108 in the spacings between stripes 104.

Several other variations in the above processes, such as would be understood by one skilled in the art to which it pertains, are considered to be within the scope of the present invention. As a first such variation, it will be understood that glass layer 88 or 108 may be deposited by a technique other than those described above, for example, chemical vapor deposition or sputter deposition. According to another variation, SOG layer 88 or 108 may be dry etched, illustratively in a plasma reactor. It will also be recognized that a hard mask, such as aluminum or gold, may replace photoresist layers 84, 90 and 104 of the above processes. Finally, photosensitive glass materials are known, and it may be possible to pattern insulator layers 88 and 108 directly, without the use of photoresists.

A field emission flat panel display device, as disclosed herein, including the opaque insulator on the anode plate thereof, and the methods disclosed herein for preparing the opaque insulating material and for applying the material to the anode plate, overcome limitations and disadvantages of the prior art display devices and methods. The opaque, electrically insulating material of the present invention fills in the gaps between the stripe conductors of the anode, thereby acting as a barrier to the entry of ambient light into the device, and further preventing the re-emergence of light reflected from the active surface of the emitter plate. In addition, by virtue of its electrical insulating quality, the opaque material serves to increase the electrical isolation of the stripe conductors from one another, thereby permitting the use of higher anode potentials without the risk of breakdown due to increased leakage current.

The use of an insulating material separating the stripe conductors of the anode also provides the advantage of improving the definition of the phosphor depositions. Finally, it is noted that the improved insulating qualities of the structure of the present invention will allow the use of narrower spacings between the stripe conductors of the anode, thereby allowing increased anode stripe widths and increasing the area coated by the phosphors. This increased phosphor area reduces the density of the electrons impinging on the phosphor, thereby improving the phosphor efficiency. Hence, for the application to flat panel display devices envisioned herein, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. An anode plate for use in a field emission device, said anode plate comprising:

an electrically insulating, transparent substrate;

spaced-apart, transparent, electrically conductive stripes on said insulating substrate, said stripes comprising anode electrodes;

luminescent material overlying said conductive stripes within an image-forming portion of said plate; and opaque, electrically insulating material on said insulating substrate, said insulating material comprising discrete elements occupying the spaces between adjacent conductive stripes within said image-forming portion.

2. The anode plate in accordance with claim 1 wherein said opaque, electrically insulating material comprises glass mixed with impurities which limit the transmissivity to visible light of said electrically insulating material to less than fifty percent.

3. The anode plate in accordance with claim 2 wherein said impurities include the oxide of a transition metal.

4. The anode plate in accordance with claim 2 wherein said impurities include the oxides of more than one transition metal, said metal oxides being selected to provide opacity over the spectrum of visible light.

5. The anode plate in accordance with claim 2 wherein said impurities include an organic dye.

6. The anode plate in accordance with claim 2 wherein said impurities include more than one organic dye, said dyes being selected to provide opacity over the spectrum of visible light.

7. An electron emission display apparatus comprising:

an emitter structure including means for providing field emission of electrons;

a display panel having a planar face opposing said emitter structure, said display panel including an electrically insulating, transparent substrate;

anode electrodes comprising spaced-apart, transparent, electrically conductive regions on said insulating substrate;

luminescent material overlying said conductive regions within an image-forming portion of said planar face; and opaque, electrically insulating material on said insulating substrate, said insulating material comprising discrete elements occupying the spaces between adjacent conductive regions within said image-forming portion; and means for applying electrical potentials between said emitter structure and said anode electrodes to accelerate electrons emitted by said emitting means toward said conductive regions.

8. The electron emission display apparatus plate in accordance with claim 7 wherein said opaque, electrically insulating material comprises glass mixed with impurities which limit the transmissivity to visible light of said electrically insulating material to less than fifty percent.

9. The electron emission display apparatus plate in accordance with claim 8 wherein said impurities include the oxide of a transition metal.

10. The electron emission display apparatus plate in accordance with claim 8 wherein said impurities include the oxides of more than one transition metal, said metal oxides being selected to provide opacity over the spectrum of visible light.

11. The electron emission display apparatus plate in accordance with claim 8 wherein said impurities include an organic dye.

12. The electron emission display apparatus plate in accordance with claim 8 wherein said impurities include more than one organic dye, said dyes being selected to provide opacity over the spectrum of visible light.

13. The electron emission display apparatus plate in accordance with claim 7 wherein said spaced-apart, transparent, electrically conductive regions comprise stripes configured as three series of parallel conductive bands on said substrate.

14. The electron emission display apparatus plate in accordance with claim 13 wherein a first series of said bands is overlaid by a luminescent material luminescing in the red, a second series of said bands is overlaid by a luminescent material luminescing in the green, and a third series of said bands is overlaid by a luminescent material luminescing in the blue.

15. The electron emission display apparatus plate in accordance with claim 13 wherein the width of the spaces between adjacent stripes occupied by said insulating material is approximately 30 microns.

16. The anode plate in accordance with claim 1 wherein said spaced-apart, transparent, electrically conductive stripes are configured as three series of parallel conductive bands on said substrate.

17. The anode plate in accordance with claim 16 wherein a first series of said bands is overlaid by a luminescent material luminescing in the red, a second series of said bands is overlaid by a luminescent material luminescing in the green, and a third series of said bands is overlaid by a luminescent material luminescing in the blue.

18. The anode plate in accordance with claim 16 wherein the width of the spaces between adjacent stripes occupied by said insulating material is approximately 30 microns.

19. An anode plate for use in a field emission device, said anode plate comprising:

an electrically insulating, transparent substrate;

anode electrodes comprising spaced-apart, transparent, electrically conductive stripes on said insulating substrate;

luminescent material overlying said conductive regions within an image-forming portion of said plate; and a semitransparent or opaque, electrically insulating material on said image-forming substrate, said insulating material comprising discrete elements occupying the spaces between adjacent conductive stripes within said image-forming portion.

20. The anode plate in accordance with claim 19 wherein said semitransparent or opaque, electrically insulating material comprises glass mixed with impurities which limit the transmissivity to visible light of said electrically insulating material to approximately three percent.

21. The anode plate in accordance with claim 20 wherein said impurities include the oxide of a transition metal.

22. The anode plate in accordance with claim 19 wherein said impurities include the oxides of more than one transition metal, said metal oxides being selected to provide reduced light transmissivity over the spectrum of visible light.

23. The anode plate in accordance with claim 19 wherein said semitransparent or opaque, electrically insulating material comprises glass mixed with an organic dye.

24. The anode plate in accordance with claim 19 wherein said semitransparent or opaque, electrically insulating material comprises glass mixed with more than one organic dye, said dyes being selected to provide reduced light transmissivity over the spectrum of visible light.

25. The anode plate in accordance with claim 19 wherein said spaced-apart, transparent, electrically conductive stripes are configured as three series of parallel conductive bands on said substrate.

26. The anode plate in accordance with claim 25 wherein a first series of said bands is overlaid by a luminescent material luminescing in the red, a second series of said bands is overlaid by a luminescent material luminescing in the green, and a third series of said bands is overlaid by a luminescent material luminescing in the blue.

27. The anode plate in accordance with claim 25 wherein the width of the spaces between adjacent stripes occupied by said insulating material is approximately 30 microns.

* * * * *